United States Patent [19]

Gugelmeyer et al.

[11] Patent Number: 4,895,530

[45] Date of Patent: Jan. 23, 1990

[54] QUICK DISCONNECT AUTOMOTIVE BATTERY CONNECTOR

[75] Inventors: Robert J. Gugelmeyer, Aurora; Lawrence E. Geib, Bartlett, both of Ill.

[73] Assignee: Molex Incorporated, Del.

[21] Appl. No.: 314,991

[22] Filed: Feb. 24, 1989

[51] Int. Cl.[4] ..... H01R 13/62

[52] U.S. Cl. ..... 439/311; 439/387; 439/851

[58] Field of Search ..... 439/387, 311–319, 439/851–858, 30, 335, 754–774, 387, 288, 289, 292, 332–338, 736

[56] References Cited

U.S. PATENT DOCUMENTS

| | | | |
|---|---|---|---|
| 1,975,467 | 10/1934 | Livingston | 439/311 |
| 2,093,037 | 9/1937 | Douglas | 439/289 |
| 3,184,703 | 5/1965 | Piscitello et al. | 439/335 |
| 3,725,840 | 4/1973 | Hesse | 439/335 |
| 4,468,078 | 8/1984 | Frear | 439/314 |
| 4,743,207 | 6/1988 | Clark | 439/317 |

*Primary Examiner*—David Pirlot

*Attorney, Agent, or Firm*—Louis A. Hecht; Stephen Z. Weiss

[57] ABSTRACT

A pair of electrical connectors are provided to enable quick connection or disconnection of a lead from an automotive battery. The connectors include mateable pin and socket terminals that are of split tube design to achieve inward deflection of the pin terminal and outward deflection of the socket terminal with correspondingly high contact forces and large contact surface areas. The terminals are securely mounted in housings that are mateable with one another. One housing preferably includes helically formed cam slots that are dimensioned to receive cam followers unitarily molded with the opposed housing. The helical cam slot provides a desirable mechanical advantage during mating and unmating and contributes to the plural directional wiping of the terminals insert molded therein.

23 Claims, 2 Drawing Sheets

QUICK DISCONNECT AUTOMOTIVE BATTERY CONNECTOR

BACKGROUND OF THE INVENTION

Many electrical components on vehicles include complex circuitry with microchips, transistors or other such intelligent control means. These complex electrical components include sound systems, alternators, ignition modules, climate control systems and instrument panels. The chips or transistors of these electrical components can readily be damaged by power surges that could occur when a vehicle is being jump started or when a battery is being charged or replaced. As a result, it is desirable to provide a means for disconnecting the electrical components having chips or transistors from the battery prior to any attempt at jump starting or prior to charging or changing the battery.

In view of this desire to protect certain electrical components from surges, some vehicles are now being manufactured with a single lead extending from the positive terminal of the battery to a splice. A plurality of separate leads will then extend from the splice. One such lead may extend to the starter. Another lead may extend to fairly simple electrical components, such as lighting groups. At least one other lead may extend to the complex components having chips or transistors therein. An appropriate disconnect means may then be incorporated into the lead extending from the battery to the components having chips or transistors. The vehicle owner and/or maintenance personnel are specifically advised to disconnect the lead to components having chips or transistors prior to jump starting or charging the battery.

Prior art connectors for high amperage applications, such as the leads extending from an automotive battery, are large and complex. The typical connector for such high amperage automotive applications includes opposed members that are bolted together. As a result, disconnection and reconnection of such connectors have been difficult. Automotive manufacturers have been concerned that the vehicle owner or maintenance personnel will merely ignore instructions to disconnect these leads prior to jump starting an engine, thereby creating a high probability of damage to the components having chips or transistors therein. The probability of a difficult disconnection being attempted is especially low in the uncontrolled environments in which most jump starting operations are required. Even if disconnection is completed, an improper reconnection would be likely for the prior art high amperage connectors employed in uncontrolled environments. The difficulty of making these complex connections and reconnections for battery lines can be particularly difficult in view of the extremely limited space in the engine compartment of vehicles. Blind connections in barely accessible locations would be common.

Many of the electrical components of a vehicle that may not necessarily incorporate chips or transistors draw extremely high current loads. One example is a defroster which may include heating elements that draw high current loads. The defroster or other such component may periodically require repair or replacement. The first step in any such repair or replacement typically is the disconnection of the high current connection to the alternator. However, as noted above, high current connectors for vehicular applications typically are large, complex and difficult to disconnect in the very limited space available in the engine compartment of a vehicle.

The prior art includes many electrical connectors that are easy to mate and unmate. However, most of these easily mateable and unmateable connectors are not well suited for the demanding high vibration automotive environment. Many others are specifically designed for small fragile terminals that would be immediately and permanently damaged if exposed to high amperage.

Some prior art connectors intended for quick connection and disconnection include opposed mateable housings having bayonet-type connections. The typical bayonet-type connection comprises a pair of generally cylindrical telescoping metallic housing members. One housing member will be provided with at least one cam while the opposed housing member will have a corresponding groove into which the cam is receivable. The connection of the two housings typically will require some combination of both axial and rotational movement dictated by the particular configuration of the groove.

Many of the prior art bayonet-type connectors comprise terminals that are movable relative to the housing to ensure that the terminals move only in an axial direction despite a rotational movement of the housing. Prior art bayonet-type connector housings may also include complex spring means for biasing the terminals into a selected axial orientation relative to the housing. Examples of prior art electrical connectors having bayonet-type connections include U.S. Pat. No. 4,645,281 which issued to Burger on Feb. 24, 1987; U.S. Pat. No. 4,737,119 which issued to Stieler on Apr. 12, 1988; U.S. Pat. No. 4,361,374 which issued to Marmillion et al on Nov. 30, 1982; U.S. Pat. No. 4,146,288 which issued to Ramsay et al on Mar. 27, 1979; U S. Pat. No. 4,464,001 which issued to Collins on Aug. 7, 1984; U.S. Pat. No. 4,359,256 which issued to Gallusser et al on Nov. 16, 1982; U.S. Pat. No. 3,425,026 which issued to Theunissen on Jan. 28, 1969; U.S. Pat. No. 3,351,886 which issued to Zimmerman on Nov. 7, 1967; and U.S. Pat. No. 3,252,124 which issued to Hansen on May 17, 1966. None of these references is directed to connectors that could be used with an automotive battery.

In view of the above, it is an object of the subject invention to provide an easily mateable and unmateable electrical connector for high amperage automotive applications.

It is another object of the subject invention to provide a quick disconnect electrical connector for automotive batteries.

An additional object of the subject invention is to provide an automotive battery connector including a bayonet-type connector housing.

A further object of the subject invention is to provide a quick disconnect battery with terminals having large cross-sectional areas, low mating forces and large contact areas.

Yet another object of the subject invention is to provide a quick disconnect battery connector having a nonconductive housing securely positioned relative to the terminal.

Still a further object of the subject invention is to provide an automotive battery connector that can readily be disconnected with one hand.

SUMMARY OF THE INVENTION

The subject invention is directed to an electrical connector for automotive batteries that enables a lead from the battery to be easily connected or disconnected by hand without special tools. The connector comprises mateable pin and socket terminals each of which has a mating end and an opposed wire mounting end. The mating ends of the terminals are each split longitudinally to define two deflectable longitudinal contacts. Thus, the longitudinal contacts of the pin terminal will deflect inwardly upon mating while the longitudinal contacts of the socket terminal will deflect outwardly upon mating. As will be explained further below, the mating of the terminals will cause the respective terminals to move both axially and rotationally relative to one another. Thus, the contacting surfaces of the terminals will wipe in plural directions during mating. In the fully mated condition, the terminals will provide a large cross-sectional area of contact between the terminals to achieve an efficient current path.

The mating ends of the terminals may be mechanically crimped onto the battery wires. Additionally, the mating ends of the terminals may be soldered to the battery wires. This redundant crimping/soldering connection of the terminals to the wires ensures a high quality connection that readily accommodates the high amperage. The terminals are securely mounted in mateable nonconductive housings.

The housings preferably are generally cylindrical in configuration and are dimensioned for telescoping engagement with one another. The housings preferably are formed to comprise a bayonet-type interengagement means. In particular, the mating end of one housing may comprise at least one generally helically extending cam groove formed therein or cam slot extending therethrough, while the opposed housing may comprise a corresponding cam follower. For example, the outer telescoping member may comprise a pair of opposed cam grooves which begin at the mating end of the housing. The entrance to the cam grooves at the mating end of the housing may be enlarged to facilitate initial alignment of the cam followers with the cam groove. The cam groove may lead into a cam slot at locations spaced from the mating end. The provision of a cam groove at the mating end rather than an opened slot prevents outward bowing or damage to the housing by initial misalignment during mating. The cam slots may terminate at a locking detent dimensioned to require a slight forcing of the cam follower. Portions of the cam slot past the locking detent may extend circumferentially rather than helically to prevent unintended disconnection in response to axial forces.

The cam followers will be dimensioned to freely move along the cam slot, such that the two connector housings can be mated with one another with a combined axial and rotational movement of the housings. The cam followers will require slight forcing at the locking detents at the end of each respective cam groove/slot. The movement of the cam follower past the dimensionally restricted locking detent will provide both an audible and a tactile indication that the housings and the corresponding terminals are fully mated.

The above described helical alignment of the cam groove or slot can provide a significant mechanical advantage during both mating and unmating. In particular, the connectors of the subject invention enable substantially easier mating than prior art battery connectors that included complex arrangements of bolts and nuts or that merely required excessively high mating forces in view of large contact areas. Additionally, the helical movement inherent in mating the subject connector housings helps to avoid the scraped knuckles and other minor injuries that would be likely to occur in connectors relying exclusively on axial movement. The mechanical advantage can further be facilitated by providing assist levers on the respective housings. The assist levers may be unitarily molded with the housings and may be disposed to extend from opposite sides of each housing generally adjacent the rear ends thereof. Assist levers may be particularly helpful in that they ensure a firm grip despite the accumulation of soil or grease in the engine compartment of a vehicle.

One hand mating or unmating can readily be achieved by mounting one of the connectors securely to a panel. For example, one of the connector housings may be unitarily molded with a mounting block having means for secure mounting to a panel within the engine compartment of a vehicle. The mounting of one connector housing to the vehicle will prevent both translation and rotation of that component. Thus it is only necessary to axially and helically advance the other connector half relative to the fixedly mounted connector half to achieve efficient mating.

DETAILED DESCRIPTION OF THE PREFERRED EMBODIMENT

Figure 1:
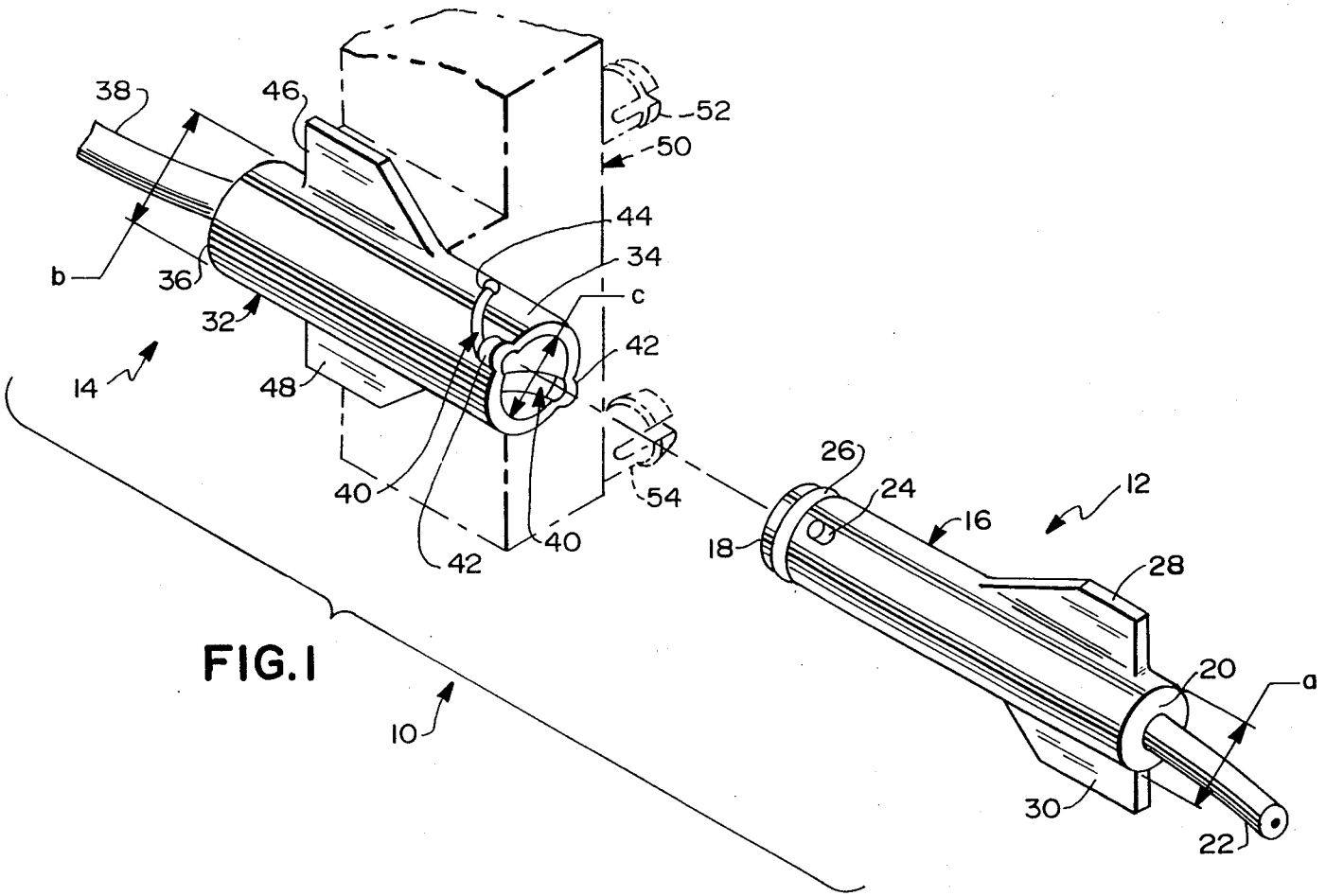
FIG. 1 is an exploded perspective view of the connectors of the subject invention.

The pair of quick disconnect battery cable connectors are identified generally by the numeral 10 in FIG. 1. The pair of connectors 10 comprise a plug connector 12 and a socket connector 14.

The plug connector 12 comprises a unitarily molded housing 16 of generally cylindrical configuration which defines an external diameter "a" of approximately 0.70 inch. The housing 16 of the plug connector 12 comprises a forward mating end 18 and a rear end 20. A #4 AWG wire 22 extends into the rear end 20 of the plug connector 12 and is securely mechanically and electrically connected to a terminal in the plug connector 12 as shown and described in greater detail below. A pair of cam followers 24 extend in generally diametrically opposed directions outwardly from the housing 16 of the plug connector 12, and are unitarily molded with the housing 16. The cam followers 24 may be of generally cylindrical configuration or may be tapered to be of generally frustoconical configuration. The cam followers 24 are spaced slightly rearwardly from the extreme front mating end 18 of the housing 16. An elastomeric seal 26 may be disposed in an annular groove intermediate the cam followers 24 and the front end 18 of the housing 16. The housing 16 may further comprise unitarily molded assist levers 28 and 30 extending from opposite sides thereof generally adjacent the rear end 20 of the housing 16. As will be explained further below, the assist levers 28 and 30 may assist in the rotational movement of the plug connector 12 during mating of the plug connector 12 with the socket connector 14.

The socket connector 14 also comprises a generally cylindrical unitarily molded plastic housing 32. The housing 32 defines an external diameter "b" of approximately 0.90 inch and an internal diameter "c" which is slightly greater than the external diameter "a" of the housing 16 on the plug connector 12. Thus, the internal diameter "c" of the socket connector 14 enables the generally cylindrical plug connector 12 to be slideably or telescopingly inserted therein.

The housing 32 of the socket connector 14 defines a front mating end 34 and a rear end 36. A #4 AWG wire 38 extends into the rear end 36 and is mechanically and electrically connected to a terminal mounted in the housing 32 as explained and illustrated further below. It is understood that other size wires can be used with the invention described herein.

The forward mating end 34 of the housing 32 is characterized by a pair of generally helical cam slots on diametrically opposite sides of the housing 32. Each cam slot 40 is dimensioned to slideably receive a cam follower on the housing 16 of the plug connector 12. Each cam slot 40 includes a grooved bridge 42 at the mating end 34 of the housing 32 which is dimensioned to permit relatively easy initial alignment and entry of the cam followers 24. The grooved bridges 42 ensure that the mating end 34 of the housing 32 retains its cylindrical configuration, and is not damaged or broken by misalignment during initial stages of mating. The cam slots 40 terminate at locking detents 44 which define widths slightly less than the widths of the cam followers 24. The movement of the cam followers 24 past the locking detents 44 will require relative rotational movement between the plug connector 12 and the socket connector 14 without corresponding axial movement. As a result, high axial pulling forces can be exerted on the respective connectors without unmating. Rather, the unmating will require a combination of rotational and axial pulling forces to be exerted. This construction substantially prevents unintended unmating of the connectors 12 and 14. The reduced dimension of each locking detent 44 provides both an audible and a tactile indication of the full mating condition. Thus, as full mating is achieved, the movement of the cam followers 24 into the corresponding locking detents 44 will be felt and/or heard by the technician completing the mating.

The housing 32 of the socket connector 14 further comprises assist levers 46 and 48 unitarily molded therewith and extending outwardly in diametrically opposite directions. The assist levers 46 and 48 are located generally near the rear end 36 of the housing 32 and provide a further mechanical advantage as had been explained with respect to the assist levers 28 and 30 on the housing 16 of the plug connector 12. To further facilitate mating, the housing 32 of the socket connector 14 may be integrally molded or otherwise securely connected to a mounting block 50 having mounting pegs 52 and 54 (and preferably an additional mounting peg which is not shown) which can be securely mounted to a panel within the engine compartment. The mounting block 50 will prevent rotation and other movement of the socket connector 14, thereby enabling the plug connector 12 to be axially and rotationally moved relative to the socket connector 14 to complete the mating or unmating. In this manner one handed mating or unmating can be achieved by the technician working with the pair of connectors 10.

Figure 2:
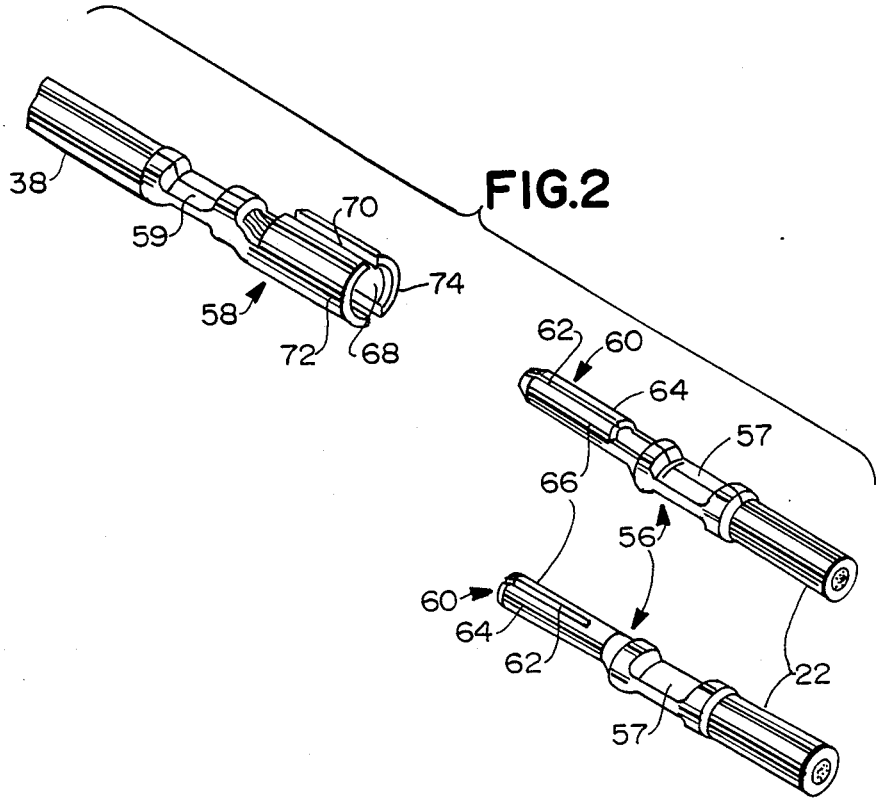
FIG. 2 is an exploded perspective view of the terminals that are mounted in the connectors of the subject invention.

The terminals of the pair of connectors 10 . are illustrated in FIG. 2. In particular, a pin terminal 56 is terminated to the #4 AWG wire 22 and is subsequently secured into the housing 16 of the plug connector 12 as explained herein. The socket terminal 58 is terminated o to the #4 AWG wire 38 and is secured in the socket connector 14. The pin and socket terminals 56 and 58 are crimped to the respective wires 22 and 38. The crimped connections may have solder applied thereon. The combination of crimping and soldering provides additional mechanical and electrical connection that may be desirable in the high amperage automotive battery application and in the high vibration environment of an automotive engine.

The terminals 56 and 58 both are of split tube design and are formed from a 0.062 inch thick copper alloy #195 tin coated. More particularly, the pin terminal 56 is stamped and formed to define a mating end 60 having a longitudinally extending slit 62 which separates opposed deflectable longitudinal contacts 64 and 66. The socket terminal 56 similarly is stamped and formed to define a mating end 68 having a longitudinal slit 70 which separates opposed independently deflectable longitudinal contacts 72 and 74. During mating, the longitudinal contacts 64 and 66 of the pin terminal 56 will deflect inwardly in response to contact with the socket terminal 58. Similarly, the opposed longitudinal contacts 72 and 74 of the socket terminal 58 will deflect outwardly in response to the mating forces of the pin terminal 56. This split tube design with both terminals deflecting ensures low and consistent mating forces and allows for multiple mating cycles. Additionally, the split tube design ensures plural points of contact. As noted above, the mating of the connectors requires both axial and rotational movement. Thus, the large contact surfaces of the terminals 56 and 58 will undergo plural directional wiping during mating to further ensure a high quality mate with plural points of contact.

It will be noted that the crimping of the terminals 56 and 58 onto the wires 22 and 38 defines flats 57 and 59, respectively. The flats 57 and 59 will help to position and retain the terminals 56 and 58 in the respective housings 16 and 32, as explained herein.

Figure 3:
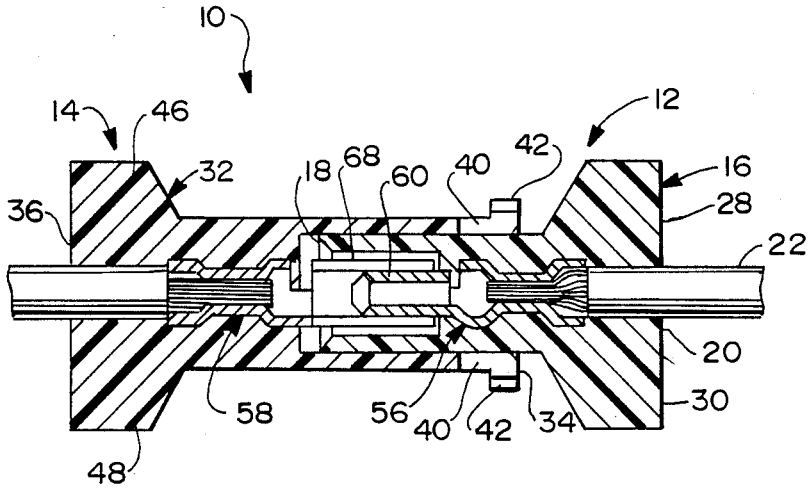
FIG. 3 is a cross-sectional view showing the connectors in their fully mated condition.

The connectors 12 and 14 are shown in their fully assembled and mated condition in FIG. 3. The connectors 12 and 14 are assembled by inserting the terminated leads (comprising terminals 56 and 58 which have been crimped onto wires 22 and 38, respectively) into terminal receiving recesses formed within housings 16 and 32. The terminals 56 and 58 are retained within their respective terminal receiving recesses by known cooperating interengaging means.

The connectors 12 and 14 may also be completed by insert molding processes wherein the terminals 56 and 58 and adjacent portions of the wires 22 and 38 are placed in molds, and the plastic material of the housings 16 and 32 are injection molded thereabout. This manufacturing process has several significant advantages. First, the carefully manufactured mold serves as final checks on the precision of the stamped and formed terminals 56 and 58. An improperly manufactured terminal 56 or 58 will not be receivable into the mold. Second, the insert molding ensures accurate positioning and retention of the terminals 56 and 58 within the molded housings 16 and 32. The molding of the plastic material of the housings 16 and 32 about the terminals 56 and 58 securely engages the flats 57 and 59 thereon to eliminate potential terminal/housing retention problems. Additionally the insert molding seals the housings 16, 32 to the wire 22, 38 and adds to the strain relief for the connectors 12 and 14, respectively. Furthermore, the insert molding provides exceptional assurance of alignment between the mating ends of the terminals 56 and 58.

As shown in FIG. 3, the mating ends of the respective terminals 56 and 58 are spaced rearwardly from the mating ends 18 and 34 of the respective housings 16 and 32. As a result the housings 16 and 32 protect the terminals prior to mating and positively prevent shorts. Additionally, the relative recessed position of the terminals 56 and 58 in the housings 16 and 32 enable the mating ends 18 and 34 of the housings 16 and 32 to assure positive alignment of the terminals 56 and 58 prior to and during mating.

In the fully mated condition, as shown in FIG. 3, there is significant overlap between the mating ends 60 and 68 of the terminals 56 and 58 respectively to assure large contact surface areas. The large surface area combined with the inward deflection of the contacts 64 and 66 on the pin terminal 56 and the outward deflection of the contacts 72 and 74 on the socket terminal 58 ensures a high quality electrical connection with an excellent current path.

In summary, a pair of mateable connectors are provided for quickly connecting and/or disconnecting high amperage leads from an automotive battery. The connectors comprise mateable terminals which are assembled into a corresponding pair of mateable connector housings. The terminals are crimped to the wires prior to the assembly process. The pair of terminals comprise mateable pin and socket terminals each of which preferably are of split tube design such that the mating end of the pin terminal deflects inwardly and the mating end of the socket terminal deflects outwardly during mating. The housings are of generally cylindrical configuration and comprise a cam slot and a mateable cam follower. The cam slot extends generally helically and terminates at a locking detent which prevents accidental unmating and provides clear audible and/or tactile assurance that the fully mated condition has been reached. The axial and rotational movement of the connectors required for mating achieves plural directional wiping with large contact surfaces and high normal contact forces. The housings of the connectors may be provided with assist levers extending diametrically therefrom to assist with the axial and rotational movement of the connectors required for mating and unmating. One of the connectors may be securely mountable to a panel to enable one handed mating or unmating.

While the invention has been described with respect to a preferred embodiment, it is apparent that various changes can be made without departing from the scope of the invention as defined by the appended claims.

I claim:

1. A pair of quickly connectable and disconnectable electrical connectors comprising:

a first connector including a first terminal having a mating end and a wire mounting end, the mating end comprising a pair of outwardly deflectable longitudinally extending contacts, the wire mounting end being securely mounted to a wire;

a first housing molded from a nonconductive material having a terminal receiving recess formed therein open at one end for receiving said first terminal therein, said first housing comprising a forward mating end with cam means for facilitating connection and disconnection of the first connector; and a second connector including a second terminal having a mating end and a wire mounting end, the mating end of said second terminal being receivable between the outwardly deflectable contacts of the first terminal, the wire mounting end of said second terminal being securely mounted to a wire;

a second housing molded from a nonconductive material having a terminal receiving recess formed therein open at one end for receiving said first terminal therein, said second housing comprising a mating end with a cam means for engaging the cam means of said first housing and guiding said first and second housings helically into a fully mated condition in which the first and second terminals are helically wiped and mated with one another.

2. Electrical connectors as in claim 1 wherein the mating end of said first terminal is of generally cylindrical configuration with a longitudinally extending slit therein defining the opposed contacts of said first terminal, the second terminal being of generally cylindrical configuration with a longitudinally extending slit defining inwardly deflectable contacts at the mating end of said second terminal, the mating end of said second terminal being receivable within the mating end of said first terminal such that the opposed contacts of said first terminal deflect outwardly upon mating and such that said contacts of said second terminal deflect inwardly upon mating.

3. Electrical connectors as in claim 1 further comprising assist levers extending from at least one of said housings, said assist levers facilitating rotation of said electrical connectors during mating.

4. Electrical connectors as in claim 1 wherein one of said first and second housings comprises means for securely connecting said housing to another structure.

5. Electrical connectors as in claim 1 wherein the first and second housings are molded about the wire mounting ends of the respective first and second terminals such that the first and second housings closely conform to and engage the respective first and second terminals and the wires mounted thereto.

6. Electrical connectors as in claim 1 wherein said first and second terminals are crimped to the respective wires.

7. Electrical connectors as in claim 6 wherein the crimping of said terminals defines flats and wherein the flats are securely engaged by the plastic material of said first and second housings by interengaging means formed in the terminal receiving recesses of said first and second housings for securely retaining the respective terminals within their respective housings.

8. Electrical connectors as in claim 6 wherein said first and second terminals are crimped and soldered to the respective wires.

9. Electrical connectors as in .claim 1 wherein the cam means of said first housing comprises a generally helical slot extending from the mating end of said first housing, the cam means of said second housing comprising a cam follower for engaging and following the cam slot of said first housing.

10. Electrical connectors as in claim 9 wherein the first housing is molded to define a grooved bridge extending across the cam slot at the mating end of said first housing, said grooved bridge being dimensioned to facilitate entry of the cam follower into the cam slot, whereby the grooved bridge prevents deformation and damage to the first housing in response to misalignment of the housings during mating.

11. Electrical connectors as in claim 9 wherein said cam slot terminates at a locking detent having a reduced dimension entry and extending in a non-helical direction, said cam follower being forcibly receivable in the locking detent for preventing accidental unmating of said connectors.

12. A pair of quick disconnect connectors for an automotive battery comprising:

a first connector comprising a generally cylindrical unitarily molded plastic housing having a mating end, an opposed wire mounting end and a terminal receiving recess extending therebetween, said mating end comprising at least one helically extending cam slot, an electrically conductive terminal securely connected to a wire and securely mounted in the terminal receiving recess of said housing, said terminal comprising a mating end spaced intermediate the opposed ends of said housing such that said housing protects the mating end of the terminal, said mating end having at least one contact; and a second connector comprising a generally cylindrical unitarily molded plastic housing having a forward mating end, an opposed wire engaging end and a terminal receiving recess extending therebetween, said forward mating end comprising a cam follower dimensioned for engaging and following the cam slot of said first connector, an electrically conductive terminal securely mounted to a wire and securely mounted in the terminal receiving recess of the housing of said second connector such that the wire extends from the wire engaging end of said housing thereof, said terminal comprising a mating end having at least one contact for electrically contacting the contact of the terminal in said first connector, the mating end of said terminal in said second connector being disposed intermediate the opposed ends of said housing such that said housing protects the terminal, whereby said connectors are mateable with one another by axially and rotationally moving said second connector relative to said first connector such that the cam follower of said second connector follows the helical cam slot of said first connector, and whereby the contacts of the terminals undergo plural directional wiping during mating.

13. Electrical connectors as in claim 12 wherein the housing of said first connector comprises mounting means integrally molded therewith for mounting said first connector to a support structure.

14. Electrical connectors as in claim 12 wherein the first and second housings are molded about the wire mounting ends of the respective first and second terminals such that the first and second housings closely conform to and engage the respective first and second terminals and the wires mounted thereto.

15. Electrical connectors as in claim 12 wherein each said terminal comprises a pair of deflectable contacts, the mating ends of said terminals being dimensioned and configured to cause said contacts thereof to deflect during mating.

16. Electrical connectors as in claim 15 wherein one said terminal defines a socket terminal having a generally cylindrical mating end with a longitudinally extending slit defining opposed deflectable contacts, the other terminal defining a pin terminal with a longitudinally extending slit defining opposed deflectable contacts, the socket terminal being dimensioned to receive the pin terminal such that the contacts of said socket terminal deflect outwardly during mating and such that the contacts of said pin terminal deflect inwardly during mating.

17. Electrical connectors as in claim 12 wherein said terminals are crimped to the respective wires, the crimping of said terminals defining flats, said flats being securely and nonrotatably engaged by the respective housings.

18. Electrical connectors as in claim 12 wherein the cam slot terminates at a locking detent having a reduced dimension entry and extending in a non-helical direction, said cam follower being lockingly receivable in said locking detent of said cam groove.

19. Electrical connectors as in claim 12 wherein said housings each comprise a pair of diametrically opposed assist levers unitarily molded therewith and extending outwardly therefrom, said assist levers facilitating the axial and rotational movement of said connectors during mating and unmating.

20. A pair of quick disconnect connectors for connection to a lead from an automotive battery, said connectors comprising:

a first connector comprising a terminal having a mating end of split tube configuration for defining a pair of generally semicylindrical deflectable contacts, said terminal comprising a wire mounting end securely mounted to a wire, said first connector further comprising a unitarily molded plastic housing having the wire mounting end of said terminal and the wire connected to said terminal securely mounted therein, said housing comprising a generally cylindrical mating end surrounding the mating end of said terminal, the mating end of said housing comprising a pair of diametrically opposed helically extending slots formed through said housing and extending helically away from the mating end of said housing, said slots terminating at locking detents having reduced dimensioned entries and extending in generally circumferential directions, grooved bridges extending across said open slots adjacent the mating end of said housing for preventing deformation of the mating end of said housing;

a second connector comprising a terminal securely connected to a wire, said terminal comprising a mating end of generally split tube configuration and defining a pair of generally semicylindrical deflectable contacts, the mating end of the terminal in said second connector being dimensioned for telescoping engagement with the mating end of the terminal in said first connector, said second connector further comprising a unitarily molded nonconductive housing having the wire mounting end of the terminal of said second connector and the wire connected thereto securely mounted in said housing, said housing further comprising a generally cylindrical mating end disposed about the mating end of the terminal mounted therein, the mating end for the housing of said second connector comprising a pair of diametrically opposed cam followers dimensioned for sliding engagement with the cam slots of said first connector, the cam followers being dimensioned for forcible movement past the reduced dimension portion of said locking detent on said first connector, whereby the first and second connectors are connectable with one another by helically moving the connectors into engagement with one another, and wherein the helical movement of the connectors achieves plural directional wiping of the telescoping terminals therein.

21. Electrical connectors as in claim 20 wherein at least one of said connectors further comprises assist levers unitarily molded with the housing thereof and extending in diametrically opposed outward directions at a location thereon spaced from the mating end of said connector housing.

22. Electrical connectors as in claim 20 wherein one of said first and second connectors comprises means for securely mounting said connector to another structure.

23. Electrical connectors as in claim 20 wherein the first and second housings are molded about the wire mounting ends of the respective first and second terminals such that the first and second housings closely conform to and engage the respective first and second terminals and the wires mounted thereto.

* * * * *